United States Patent [19]

Patriksson

[11] 4,196,865

[45] Apr. 8, 1980

[54] METHOD FOR THE TRANSFER OF A FORWARDS-TRAVELLING MATERIAL WEB FROM A FIRST TAKE-UP ROLLER TO A SECOND TAKE-UP ROLLER AND MEANS FOR CARRYING OUT THE METHOD

[76] Inventor: Stig S. Patriksson, Lovstigen 3, S-463 00 Lilla Edet, Sweden

[21] Appl. No.: 952,706

[22] Filed: Oct. 19, 1978

[51] Int. Cl.[2] ..... B65H 19/26

[52] U.S. Cl. ..... 242/56 R

[58] Field of Search ..... 242/56 R, 56 A, 67.1 R, 242/67.3 R

[56] References Cited

U.S. PATENT DOCUMENTS

| | | | |
|---|---|---|---|
| 3,062,465 | 11/1962 | Hunter | 242/56 R |
| 3,345,009 | 10/1967 | Rockstrom | 242/56 A |
| 3,539,125 | 11/1970 | Patrikson | 242/56 R |
| 3,592,403 | 7/1971 | Schmitt | 242/56 R |
| 3,610,545 | 10/1971 | Reifenhauser | 242/56 R |

*Primary Examiner*—Edward J. McCarthy

[57] ABSTRACT

The present invention relates to a method and a device for the transfer of a forwards travelling material web from a first take-up roller, after a terminated winding-up of the material web on said take-up roller, to a second take-up roller, which is kept ready in position close to the forwards travelling material web. The method includes crosswise sectioning of the web to form a front end of the forwards travelling material web and transferring said front end to said second take-up roller in order to wind up the material web on the same, which in connection therewith is kept rotating at a speed adapted to the speed of the forwards travelling material web. The forwards travelling web is caught at a section which results in said crosswise sectioning of the material web and a portion of the material web at the section caught in a bag-shaped condition is brought round said second take-up roller in its sense of rotation, until said portion is pinched between the forwards travelling material web and said second take-up roller. Thus said portion is carried along by the same together with a front end of the material web formed by said crosswise sectioning, which front end is arranged to be set free from its clamped condition.

5 Claims, 3 Drawing Figures

Figure 1:
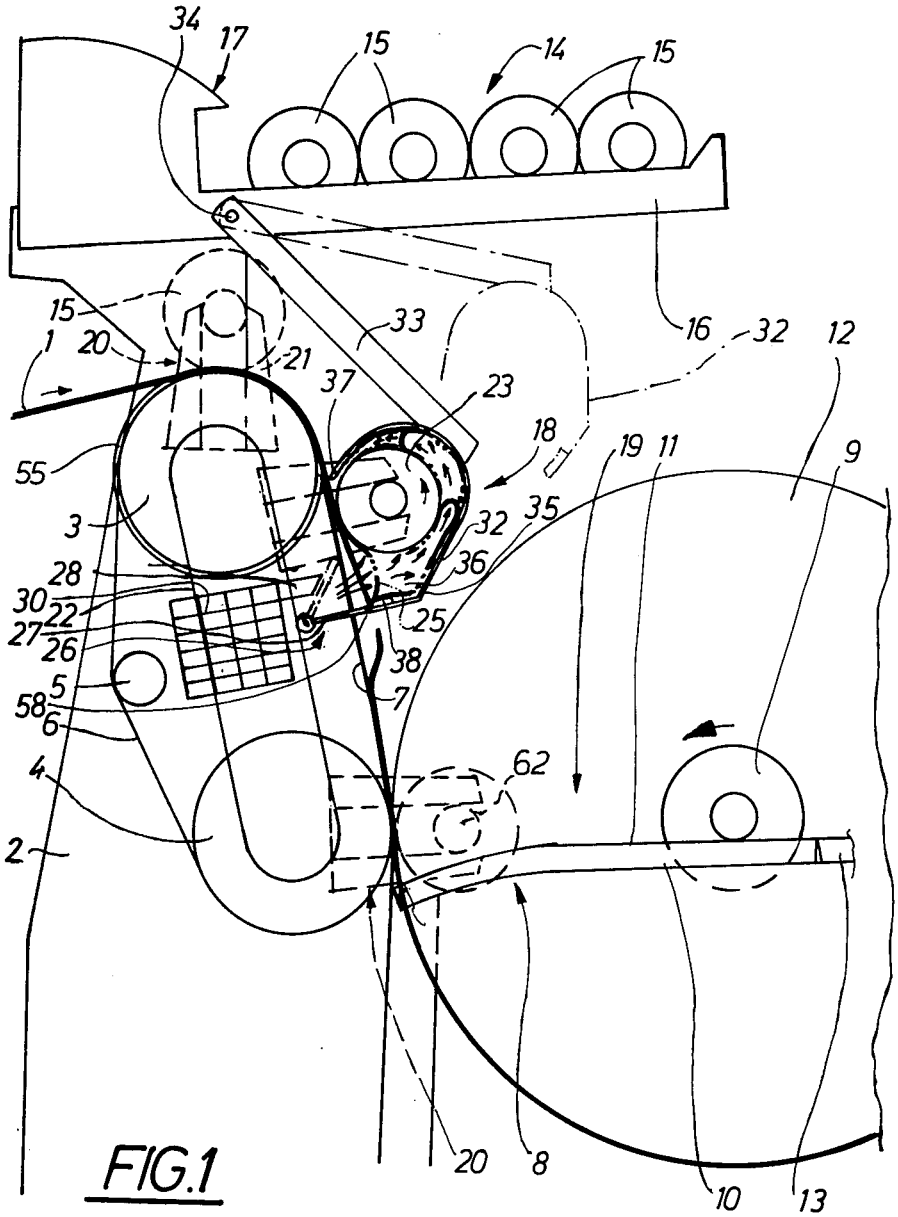

METHOD FOR THE TRANSFER OF A FORWARDS-TRAVELLING MATERIAL WEB FROM A FIRST TAKE-UP ROLLER TO A SECOND TAKE-UP ROLLER AND MEANS FOR CARRYING OUT THE METHOD

The present invention relates to a method for the transfer of a forwards travelling material web from a first take-up roller, after a terminated winding-up of the material web on said take-up roller, to a second take-up roller, which is kept ready in position close to the forwards travelling material web, by crosswise sectioning of the web to form a front end of the forwards travelling material web and transferring said front end to said second take-up roller in order to wind up the material web on the same, which in connection therewith is kept rotating at a speed adapted to the speed of the forwards travelling material web.

The present invention also refers to a device for the accomplishment of the method according to the present invention.

In connection with different kinds of manufacture and other type of handling of web shaped products, there is usually a step, where the forwards running material web is wound up on take-up rollers in order to form rolls. When the winding-up operation to form a roll has been terminated, the material web is transferred to a new take-up roller, while the finished roll is carried off, and the new take-up roller is usually brought to occupy the position of the finished roll, the material web during the whole operation continuing its high speed forward feed without interruption. The transfer of the material web must take place as rapidly as possible in order to avoid unnecessary and expensive materials waste, which is a problem that has been aggravated in accordance with the industrial development, the tendency being ever increasing speeds of the web in order to get a maximum capacity of the machinery used. It is moreover important to reduce the materials waste in consideration of the common interest to be economical with raw material and energy resources. Furthermore, any satisfactory solution of the problem of attaching multilayer material webs to a take-up roller, thus, where all the material layers must be given a secure fixing has not yet been brought forward.

The conventional technique in connection with the transfer of paper webs from one take-up roller to another still involves the use of a bonding agent as glue being glued on the take-up roller, whereafter the paper web is cut off, the front end formed thereby being brought against the roller and glued on to its mantle surface by means of the glue, whereby the material web is taken up by the take-up roller. This technique does not permit any instantaneous transfer of the material web, which produces a materials waste, that can be quite considerable even during short periods of time due to the prevailing high speeds of the web. Due to these high speeds of the web, another problem has in addition arisen, viz. difficulties to hold the glue on the take-up roller. It has in fact turned out that in connection with high speeds of the web the risk arises that the bonding agent is thrown off on account of the centrifugal force in spite of the rollers being provided with sleeves of cardboard onto which the bonding agent is brought. When multilayer material webs are wound up, this technique can moreover not be applied without great difficulties arising.

Even if one has tried to solve the problems arising in connection with conventional techniques, one has not been successful in bringing forward any satisfactory solutions. Experiments have been made with air jets in order to move the front end of the material web formed in connection with the cutting off operation round the take-up roller but hitherto one has not succeeded to control this end in an efficient manner and one has neither been able to secure the fitting of the material web to the take-up roller.

It is an object of the present invention to eliminate the above mentioned problems and secure a very rapid and reliable transfer of the material web in order to obtain a minimum of material or no material waste at all in connection with single layer as well as multilayer material webs.

Said object is reached by means of a metnod according to the present invention characterized by that the forwards travelling web is seized at a section which results in said crosswise sectioning of the material web, that a portion of the material web at the section caught in a bag-shaped condition is brought round said second take-up roller in its sense of rotation, until said portion is pinched between the forwards travelling material web and said second take-up roller, whereby said portion is carried along by the same together with a front end of the material web formed by said crosswise sectioning, which front end is arranged to be set free from its clamped condition.

Said object is also reached by the device arranged for the accomplishment of the method according to the present invention.

Figure 2:
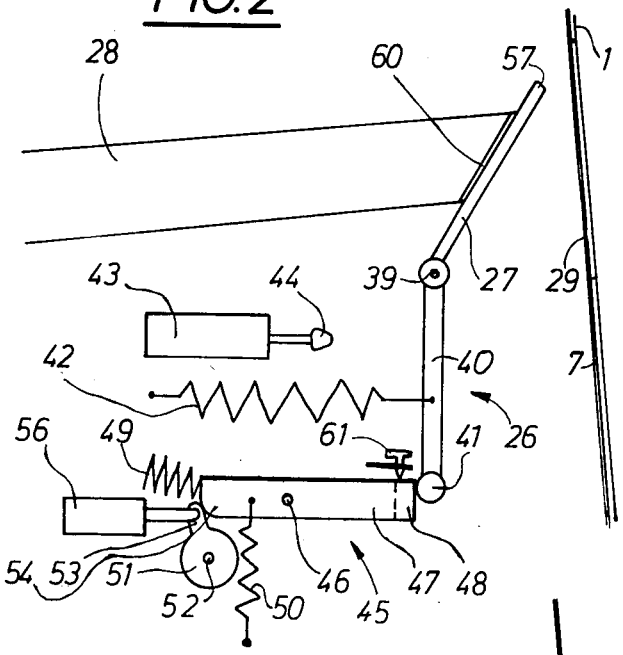
Figure 3:
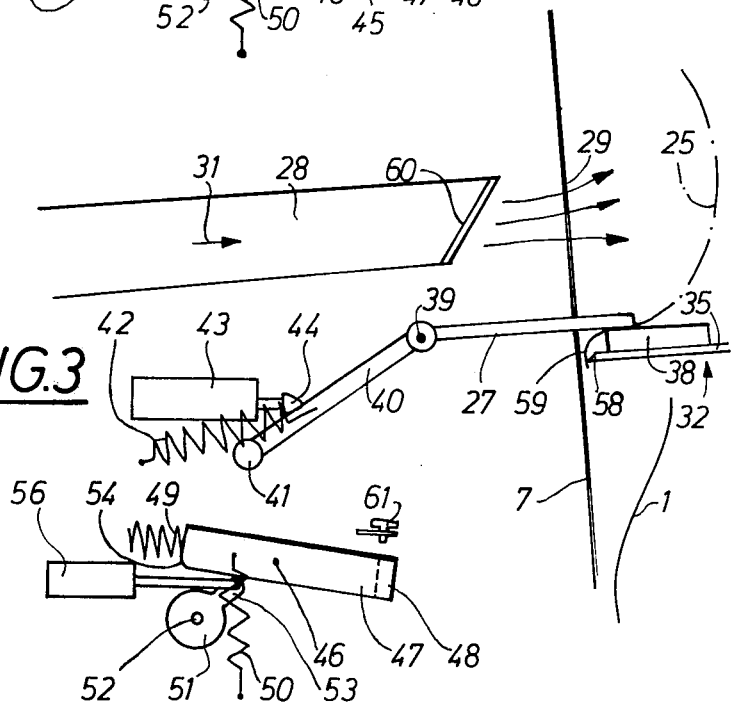

The invention will now be described more in detail by means of an embodiment, reference being made to the accompanying drawing, in which FIG. 1 is a side elevational view of a take-up machine provided with a means according to the invention, FIGS. 2 and 3 showing schematically a mechanism forming part of the means according to the invention and securing the transfer of the material web.

The fundamental idea of the invention lies in catching the material web and forming a bag-shaped portion, which is brought round a rotating take-up roller in the rotating direction of the roller instead of cutting the material web and thereafter trying to get control of the front end of the forwards running material web thereby produced and attach it to the take-up roller. The catching operation brings in its train that the material web is cut off, and when the bag-shaped portion is pinched between the take-up roller and the forwards running material web, the pinched front end of the material web formed in connection with the cut-off operation is carried along by the take-up roller.

An example of a device serving the purpose to realize the fundamental idea of the invention is thus evident from the FIG. 1, which shows a take-up machine for a material web 1, by way of example a paper web. The take-up machine comprises a frame 2, in which an upper driving roller 3 and a lower driving roller 4 are pivoted. The driving rollers 3,4 are rotated by means of a driving means, not shown, which by way of example is connected with the lower driving roller 4. A number of belts 6 are provided to run round the two driving rollers and a pulley roller 5, which belts 6 are uniformly distributed over the periphery of the driving rollers being positioned with an interspace and countersunk in recesses of the mantle surface of the driving rollers in such a way that the driving rollers together with the belts form a substantially smooth surface. A supporting plate 7 extends between the two driving rollers 3 and 4 in substantially tangential direction on one side of them and substantially over their whole width, said supporting plate 7 being designed in a manner corresponding to the mantle surface of the driving roller, i.e., with recesses in order to take up the driving belts, so that the supporting plate together with the driving belts form a substantially smooth surface. An acceleration ring 55 is located at each end of the upper driving roller 3 and extends somewhat outside of the periphery of the driving roller being arranged to rotate together with the driving rollers 3,4.

A winding up ramp 8 protrudes from the frame 2, said ramp being intended to support a first take-up roller 9. This roller rests in rotatable arrangement on two arms 10, which extend on each side of the take-up roller 9. This roller is supported in such a way that it permits being displaced along a supporting surface 11, which in the illustrated example is designed according to a predetermined curved form. This supporting surface 11 is preferably chosen in order to give a substantially constant abutting pressure of a mother-roll 12 against the lower driving roll 4, said mother roll 12 being formed in the course of it being wound up on the take-up roller 9. By this arrangement a uniform hardness is obtained for the mother roll, which can be adjusted by changing the inclination of the winding-up ramp 8. For this purpose the ramp 8 is pivoted in the frame 2 in manner known per se (not shown). An unwinding ramp 13 is in articulated mounting connected with the two arms 10.

The frame 2 in its top portion further supports a supply station 14 with a number of take-up rollers 15, which are arranged to roll on an inclined courseway 16 in direction towards a depositing means 17. This means 17 is provided with segments known per se (not shown), which are arranged to feed down the take-up rollers 15 one at a time.

The take-up machine moreover comprises a means for the displacement of the take-up rollers from the supply station 14 to a transfer station 18, which will be described more in detail below, and from there to a take-up station 19, which substantially comprises the winding-up ramp 8. In the example shown said means for displacement comprises a fork device 20 substantially constituted by two forks 21, one at each end of the frame 2, which forks are arranged to be displaced along a guide, not shown, by means of parallelly driven closed chain loops 32.

The means further comprises a device according to the invention serving the purpose to transfer the material web from the first take-up roller 9 to a second take-up roller 23, which rests in the fork device 20 at the transfer station 18. This transfer device is substantially arranged for one thing to catch the forwards running material web 1 and for another thing to bring a portion 25 of the material web in a bag-shaped condition round said second take-up roller 23. A flap mechanism 26 forms part of this transfer device and is provided with a number of flaps 27, which permit a change-over between a rest position (illustrated in FIG. 1 by a dashed and dotted line), and a catch position (illustrated with a continuous line). In the rest position the flaps 27 are arranged to close the orifice 60 of a number of air channels 28 (see also the FIGS. 2 and 3), which are located right in front of air vents 29 in the supporting plate 7. As is schematically illustrated in FIG. 1, the air channels 28 are brought together to form a battery of air intakes 30, where an air fan or similar, not shown, is provided in order to generate an air flow in the channels 28 in the direction of the arrow 31. The air fan is arranged to be functioning on certain occasions and substantially, when the flaps 27 are in their catching position.

The transfer device according to the invention also has a transfer hood 32, said hood being suspended in the outer end of a supporting arm 33, which is pivoted by means of a pivoting arrangement 34 in the frame 2. The transfer hood 32 is designed in such a manner that together with the supporting plate it substantially encloses the take-up roller 23 located at the transfer station 18, and it can be reset in another position by means of a driving mechanism, not shown, by way of example a pneumatic piston-cylinder mechanism for the pivoting of the supporting arm 33 between a rest position, which is shown with a dashed and dotted line, and a transfer position at the transfer station 18 close to the supporting plate 7 and the material web 1. The transfer hood 32 is dimensioned in such a manner that between the take-up roller 23 and the wall 35 of the transfer hood a space 36 is created, which in the example illustrated is right in front of the openings 29 and thereafter gradually diminishes towards the opposite end 37 of the space. At the lower edge portion of the transfer hood 32 a longitudinally extending stop 38 is provided, which for example is designed with a friction surface, which possibly has a somewhat yielding property. The stop is by way of example made of rubber, plastics or similar. This stop 38 occupies such a location in the transfer position of the transfer hood 32 that it forms a stop clog for the flaps 27 in their catching position. Said edge portion of the hood is designed as a tearing off edge 58. This can be designed either with a toothed or a straight edge.

In the FIGS. 2 and 3 an example is shown of the above mentioned flap mechanism 26 with the flaps 27 in rest position (see FIG. 2) and in catching position (see FIG. 3). The flaps 27 are pivoted round a shaft 39 extending at a suitably chosen distance from the supporting plate 7, and this shaft 39 has an operating arm 40, which is suitably common to a number of flaps. The flaps can be divided up in a number of groups, in which the flaps are groupwise rigidly connected with each other. Each group of flaps by way of example has two operating arms 40 with an interposed operating bar 41. A tension spring 42 belongs to each group and tends to bring the flaps 27 from their rest position illustrated in FIG. 2 to their catching position shown in FIG. 3. In each group there is further a mechanism serving the purpose to return the flaps from the catching position to the rest position. In the example shown this mechanism comprises a pneumatic piston-cylinder unit 43, which is arranged with a return pin 44 to bring about said return movement by cooperation with the operating arms 40. In order to eliminate any unneccesary slowness in the movement of change-over from the rest position to the catching position, the piston-cylinder unit 43 in the illustrated example is arranged in such a manner that the return pin 44 is kept moved aside in its rest position shown in FIG. 2. A releasing mechanism 45 further forms part of the flap mechanism, which release mechanism comprises two two-armed levers 47 pivoted round an axis 46 and via a dolly-ledge 48 connected with each other, against which dolly-ledge the operating bar 41 rests in the rest position of the flap mechanism according to FIG. 2. The dolly-ledge 48 has a length which substantially corresponds to the width of the material web and extends transversely. The releasing mechanism has further an overcenter spring 49 and a tension spring 50, which tend to hold the two-armed levers in their position shown in FIG. 2. The releasing mechanism 45 further comprises a cam plate 51, which is pivoted round an axis 52 and which has a cam 53 arranged to cooperate with an edge surface of the lever 47. The cam plate 51 can be changed with respect to its position between the rest position shown in FIG. 2 and the activating position shown in FIG. 3, the setting being carried out by means of control mechanism, which in the illustrated example comprises a piston-cylinder unit 56, by way of example of pneumatic type. The cam 53 is suitably adjustable with respect to its length or angular position. The rest position of the dolly-ledge 48 according to FIG. 2 is adjustable by means of a displaceable dog in the form of for example an adjusting screw 61. The position of the dolly-ledge 48 is essential for the speed of the flap mechanism and shall be adjusted in such a manner that its travelling path to a position, where it is moved away from the operating bar 41, will be the shortest one possible.

During the winding-up operation of the material web 1 round the take-up roller 9 on the winding-up ramp 8 in the winding-up station 19 to form a mother roll 12, the take-up roller 15 positioned nearest to the deposition means 17 is picked up from the supply station 14, which take-up roller 15 by means of the deposition means is brought down to the fork device 20. In this situation this fork device is in its upwards pointing position below the deposition means 17 of the supply station 14. The take-up roller 15 is thereby brought into contact with the rotating acceleration rings 55, whereby the take-up roller is accelerated to the speed of the material web 1 while being displaced to the transfer station 18 by the fork device 20. During this displacement the take-up roller 15 is not in contact with the material web 1, but reaches the same only when the take-up roller has almost reached the transfer station, in which connection the speed of the material web has been reached. The transfer hood 32 is thereby swung down from its rest position (dashed and dotted lines) to its transfer position (continuous lines). When the winding-up of the material web 1 on the take-up roller 9 in the winding-up station 19 shall be interrupted, i.e., when the mother roll 12 has reached a desired size, and the transfer of the material web 1 shall take place to the take-up roller 23 located in the transfer station 18, the following occurs. The piston-cylinder unit 56 is activated, whereby the cam plate 51 is swung round from the position illustrated in FIG. 2 to the position illustrated in FIG. 3. The two-armed levers 47 by actuation of the cam 53 upon the edge portion 54 under cooperation of the overcenter spring 49, when its line of action has passed the axis 46, quickly tilts over to the position shown in FIG. 3, whereby the dolly ledge 48 is pulled away from the operating bar 41. This brings in its train that the flaps 27 under the bias of the tension spring 42 are swung out of their rest position according to FIG. 2 closing the orifice 60 of the air channels 28 and arriving in the catching position according to FIG. 3. This change-over movement takes place very rapidly and synchronous for all the flaps 27.

When the flaps 27 are swung round to the catching position according to FIG. 3, their free ends 57 are brought through the air vents 29 and arrive in contact with the material web 1, which thus carries along the flaps in direction into the stop and locks the flaps to the same. Thus, the tension spring 42 is necessary only for the start of the movement of the flaps. Thereby the material web 1 is braked and subjected to a strong racking stress below the point, where it has been caught, i.e., the stop 38, while the material web is brought against the tearing-off edge 58. When the flaps 27 are changed over from their rest position to their catching position, also the orifices 60 of the air channels 28, which are closed in the rest position of the flaps, are uncovered, and in connection therewith, suitably a little earlier, the air fan is started, so that an air current in the channels immediately can flow out through said orifices and through the air vents 29 of the supporting plate 7 and to the forwards running material web, which thus has been caught against the stop 38. As is evident from the FIGS. 1 and 3 a bag-shaped portion 25 is formed behind the caught section, said portion by means of the air current being introduced into the space 36 of the transfer hood 32, and successively brought into abutting contact for one thing with the wall 35 of the transfer hood and for another thing with the mantle surface of the take-up roller 23 in the transfer hood. After the locking of the material web 1 this is torn off against the tearing-off edge 58 simultaneously with the formation of the bag-shaped portion 25. By the tearing-off operation a front end 59 is formed, the holding of which is secured essentially as a result of the air current, which by pressure force holds the material web against the wall 35 of the transfer hood 32. The formation of the bag-shaped portion 25 in the space 36 inside the transfer hood 32 only takes place at one half of the feeding speed of the material web 1, which keeps the acceleration of the formation of the bag-shaped portion at a level that is controllable, so that a suitable overpressure and thereby a driving force of the air current can be maintained, while the bag-shaped portion round the take-up roller 23 is being formed. When the bag-shaped portion 25 has passed out through the further end 37 of the space 36 and reaches contact with the material web 1 running forwards from the upper driving roller 3, the bag-shaped portion 25 is pinched between the forwards running material web and the take-up roller 23, whereby a pulling force is created in the portion of the material web lying against the wall 35 of the transfer hood 32 and being carried along by the take-up roller 23. The forwards running material web 1 is thus attached to the take-up roller 23 by pinch action, in which connection the bag-shaped portion 25 of the material web 1 constitutes a double folded portion nearest to the mantle surface of the take-up roller.

Thus, the material web 1 has thereby been transferred from the winding-up round the take-up roller 9 located at the winding-up station 19 to a new take-up roller, i.e., to the take-up roller 23 located at the transfer station 18 without any unnecessary waste or stoppage interrupting the process. Because of the fact that the double-folded innermost portion of the material web forms a completely smooth underlayer, neither will there arise any wrinkling phenomenon, which otherwise as a rule brings in its train that quite a great number of layers of the finished roll must be maculated.

During the transfer step described above, the finished mother roll 12 is removed from the winding-up station 19 by being rolled away from the winding-up ramp 8 onto the unwinding ramp 13 for subsequent handling steps. When the transfer of the material web 1 to the take-up roller 23 at the transfer station 18 has been finished, the air current through the air channels 28 are brought to cease by shutting off the air fan, and the flaps 27 are returned by means of the piston-cylinder unit 43, whereby the returning bar 44 of the operating arm 40 is moved from the position shown in FIG. 3 to the position shown in FIG. 2. The cam plate 51 is thereby returned by the piston-cylinder unit 56 to the position illustrated in FIG. 2, whereby the two-armed levers 47 are swung back under the bias of the tension spring 50, when the operating bar 41 has been moved past the dolly ledge 48. The transfer hood 32 is swung up into its rest position indicated with dashed and dotted lines according to FIG. 1. Thereafter, the take-up roller, which is kept rotating by its contact against the belts 6, is moved down to the winding-up station 19 under continued winding-up of the material web 1. The rotation of the take-up roller at the winding-up station 19 is brought about by the contact of the mother roll formed on the take-up roller against the mantle surface of the lower driving roller 4 and the belts 6 running round in a closed path. As has been mentioned above, the take-up roller 9 in this connection rests on the arms 10 of the winding-up ramp and is displaced along the curved supporting surfaces 11. When the mother roll has acquired such a size that the shoulder portion 62 of the take-up roller has been displaced out of the forks 21, the fork device 20 is moved by means of its driving means in backwards direction to its position of reception under the deposition means 17 of the supply station 14 in order to receive a new take-up roller 15, which is subsequently displaced downwards to the winding-up station while being accelerated as a result of its contact with the acceleration rings 55 and thereafter is in stand-by position ready for a new transfer of the material web 1 to this take-up roller, when the winding-up on the take-up roller located at the winding-up station has been terminated, all in accordance with the sequence of steps described above.

The invention is not limited to the example described above and illustrated in the drawing, but can be varied within the scope of the following claims. By way of example it is in itself imaginable that the bag-shaped portion, after the pinching of the material web has taken place, is moved aside by other means than an air current, for example by means of a wire or similar stretched in the longitudinal direction of the roller, which wire or similar is arranged to be displaced round the take-up roller at the transfer station, whereby the transfer hood 32 would not be necessary. The mechanism for catching the material web can likewise be designed in many different ways, and by way of example the flaps can be substituted by a rapidly projecting pinching ledge, and other means can be arranged in order to apply the air current against the material web. Moveover, it is in itself imaginable that the stop 38 is rigidly fixed relative to the frame 2. The winding-up machine illustrated can be integrated into a paper machine in order to produce paper or into a machine for the manufacture of plastic foil or for the treatment of material webs of other kind, which permits being wound up. Even if it has not been evident from the above, the take-up rollers are usually provided with removable sleeves of steel or cardboard, to which the material web is fastened. As has been mentioned in the preamble, the material web can be composed of several material layers. The tearing-off edge 58 can in certain cases be left out or not be provided with a sharp edge, for example in connection with webs having crosswise extending perforations, which burst in connection with the tensional pull arising as a consequence of the catching of the material web. Thus, the tearing-off point does not need to coincide with the catching point. The tearing-off can likewise take place at a moment, which depends upon the extensibility of the material web.

I claim:

1. Device for the transfer of a forwards travelling material web from a first take-up roller after a terminated winding-up of the material web on said take-up roller to a second take-up roller, which is kept ready in a position close to the forwards travelling material web, by a crosswise sectioning of the web to form a front end of the forwards travelling material web and transferring said front end to said second take-up roller in order to wind up the material web on the same, which in connection therewith is kept rotating at a speed adapted to the speed of the forwards travelling material web, comprising driving means serving the purpose of keeping the first take-up roller and the second take-up roller in rotation at a winding-up station and a transfer station respectively, means for the displacement of said second take-up roller from the transfer station to the winding-up station, a device for the catching of the material web at a section of the same resulting in said crosswise sectioning of the material web, and a device for the winding-on in a bag-shaped condition of a portion of the material web at the section caught round said second take-up roller in its sense of rotation until said portion is pinched between the forwards travelling material and said second take-up roller.

2. Device according to claim 1, wherein the device for catching of the material web comprises a flap mechanism, which is arranged to pinch the material web against a stop, and a tear-off edge located in the direction of the forward feed of the material web as seen before said stop, and the device for winding-on of the material web round said second take-up roller comprising a device serving the purpose of directing an air current against said portion of the material web, which is positioned behind the section caught, and wherein a transfer hood is arranged partly to enclose said second take-up roller and around the same to form a space, in which said portion of the material web in bag-shaped condition is brought round the take-up roller.

3. Device according to claim 2, wherein said stop and tear-off edge is provided at an edge portion of the transfer hood.

4. Device according to claim 2 wherein the flap mechanism comprises a number of flaps, which are arranged to be changed over from a rest position, in which a number of air channels for said air current are kept closed, and a catching position, in which the air channels are uncovered and the material web is pinched against the stop.

5. Device according to claim 4, wherein the flap mechanism comprises a spring mechanism, which is arranged to pre-stretch the flaps in direction towards the catch position, and a releasing mechanism, which can be changed over between a rest position, in which the flaps are kept in rest position, and a position, in which the releasing mechanism is moved aside, permitting the change-over of the flaps to the catch position.

* * * * *